US009751237B2

(12) United States Patent
Steele

(10) Patent No.: US 9,751,237 B2
(45) Date of Patent: Sep. 5, 2017

(54) MANUAL CEMENT MIXER WITH MULTIPLE MIXING TROUGHS

(71) Applicant: Stephen D. Steele, Novato, CA (US)

(72) Inventor: Stephen D. Steele, Novato, CA (US)

( * ) Notice: Subject to any disclaimer, the term of this patent is extended or adjusted under 35 U.S.C. 154(b) by 27 days.

(21) Appl. No.: 14/078,290

(22) Filed: Nov. 12, 2013

(65) Prior Publication Data

US 2014/0133261 A1 May 15, 2014

Related U.S. Application Data

(60) Provisional application No. 61/725,415, filed on Nov. 12, 2012.

(51) Int. Cl.

| | |
|---|---|
| ***B28C 5/44*** | (2006.01) |
| ***B28C 5/48*** | (2006.01) |
| ***B28C 5/18*** | (2006.01) |
| ***B01F 11/00*** | (2006.01) |
| ***B01F 15/00*** | (2006.01) |

(52) U.S. Cl.

CPC ..... *B28C 5/44* (2013.01); *B01F 11/0002* (2013.01); *B01F 15/00506* (2013.01); *B01F 15/00876* (2013.01); *B28C 5/18* (2013.01)

(58) Field of Classification Search

CPC ..... B01F 15/00506; B01F 15/00876; B01F 11/006; B01F 11/0062; B01F 11/0002; B01F 11/0017; B01F 11/0025; B01F 2215/0047; B28C 5/18; B28C 5/1806; B28C 5/1818; B28C 5/1825; B28C 5/1843; B28C 5/1875; B28C 5/1881; B28C 5/1887; B28C 5/2063; B28C 5/44; B28C 5/485; B28C 5/48; E04G 21/00; E04G 21/025; G03D 3/04

USPC ..... 366/15, 47, 48, 53, 237; 220/500, 506; D15/19; 68/173

See application file for complete search history.

(56) References Cited

U.S. PATENT DOCUMENTS

| | | | | | |
|---|---|---|---|---|---|
| 747,849 | A | * | 12/1903 | Bierley | D06F 27/00 68/173 |
| 1,293,506 | A | * | 2/1919 | Miller | 366/53 |
| 1,324,257 | A | * | 12/1919 | Leach | 366/53 |
| 1,505,263 | A | * | 8/1924 | Hewitt | 366/53 |
| 2,793,788 | A | * | 5/1957 | Lysne | 220/631 |
| 4,707,140 | A | * | 11/1987 | Mohrlang | 366/186 |
| 5,934,800 | A | * | 8/1999 | Bonacci | 366/47 |

* cited by examiner

*Primary Examiner* — Tony G Soohoo
*Assistant Examiner* — Elizabeth Insler
(74) *Attorney, Agent, or Firm* — Craig M. Stainbrook; Stainbrook & Stainbrook, LLP

(57) ABSTRACT

A manual cement mixer having a mixing box with an open top, generally planar front side and rear side panels, and arcuate, parabolically curved, right and left sides forming left and right arcuate troughs, and a medial trough disposed therebetween, the troughs defining a mixing volume; a base frame for supporting said mixing box; and pivoting means for mounting said mixing box on said base frame and for manually inducing oscillations in said mixing box.

18 Claims, 5 Drawing Sheets

MANUAL CEMENT MIXER WITH MULTIPLE MIXING TROUGHS

CROSS REFERENCES TO RELATED APPLICATIONS

The present application claims the benefit of U.S. Provisional Patent Application Ser. No. 61/725,415, filed Nov. 12, 2012 (Nov. 12, 2012).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

Field of the Invention

The present invention relates generally to cement mixers, and more particularly to manually operated cement mixers, and still more particularly to a manually operated cement mixer having a plurality of mixing troughs.

Background Discussion

Concrete is the most wide used manmade construction material in the world. In the United States alone, concrete production and installation is a $35 billion industry, employing more than two million workers. Approximately 7.5 billion cubic meters of concrete are made each year—more than one cubic meter for every person on Earth.

QUIKRETE, of Atlanta, Ga., is the nation's largest manufacturer of packaged concrete and cement mixes and has more than 90 manufacturing facilities in the United States, Canada, Puerto Rico and South America, so that it can meet the customer demand for its products. That demand comes from both trade professionals and amateur "do-it-yourselfers." Each year concrete is used for hundreds of thousands of small and large projects: cementing fence posts and mailbox posts, pouring steps, concrete slabs, small foundations, and footings for walls, and so forth. The variety of tasks is nearly endless. [QUIKRETE is a registered trademark of Quikrete, International, Inc., of Atlanta, Ga..]

Traditionally, concrete for small jobs is mixed offsite and delivered in small mixer trailers, or it is mixed on-site using electric mixers ranging in size from 1.5 cubic feet to 6-9 cubic feet. The shortcoming in using such mixers is that they require electrical power and are difficult to transport and store. Further, they can range in cost from a few hundred dollars to several thousands of dollars, depending on size and quality.

For the do-it-yourself homeowner, when faced with a small concrete job requiring small volumes of concrete, there are three options typically considered for mixing the concrete manually: The first is to mix the concrete in a wheelbarrow or a bucket; the second is to use disposable concrete mixing bags, with costs hovering at about $90 for a 12-pack; and the third is to mix on a disposable tarp. In all three cases, the job requires a great deal of work over and above mixing concrete, particularly when it comes to cleanup.

As an option, and electric motor driven cement mixer can be employed. These mixers can mix from 1 to 9 cubic feet of concrete in a batch and generally cost between $300 and $2,000 depending upon the size and quality of the machine. In addition they are heavy and difficult to operate. Well-known examples include the Cleform Gilson 400UT towable mixer, the KPRO 3.6 or KPRO 6 from Kushlan Products, and the Buffalo Concrete Mixer from Cleveland Steel Tool of Cleveland, Ohio. If a power supply is not available for any of these mixers, use of such an electrically powered mixer is simply not an option. Those needing a non-electric solution often resort to the use of buckets or wheelbarrows, each of which requires considerable physical strength and effort.

An alternative to wheelbarrows, tarps, and buckets can be found in U.S. Pat. No. 1,505,263, to Hewitt. This antique patent teaches a mixer having a container pivotally mounted in a frame and provided with handles for manually oscillating the trough back and forth. The trough is configured with sides that curve gradually and uniformly inwardly so as to "prevent the formation of eddies in the load as it is agitated." Indeed, at several points in the disclosure, the patentee in Hewitt '263 emphasizes that the "peculiar configuration of the bottom of the trough serves to prevent eddies and the like."

The patent to Hewitt was an inspiration for the present invention, inasmuch as it initially appeared to represent a viable alternative to other manual means of mixing concrete. However, experiments with the apparatus described in the '263 patent showed it to be deficient in several respects, notably relating to the configuration of the trough bottom. After constructing a faithful replica of the apparatus taught in the '263 patent, tests conducted showed that the basic principle of an oscillating mixer generally works for its intended purpose. That is, tilting a mixing trough to the right moves the cement, sand, gravel and water to the right compartment of the trough. As the trough is brought back to its, neutral, central position, the slurry is accelerated down the side of the trough, through the curved bottom of the right compartment and sent spilling over the medial rib. Continuing past the central point and tilting the mixing trough to the left moves the remaining slurry to the left compartment of the trough. Again, as the trough is brought back to its, neutral, central position, the slurry is accelerated down the straight side of the trough, through the curved bottom and sent spilling over the medial rib.

However, the apparatus described in the '263 patent was shown to require considerable time and effort to completely and thoroughly mix (completely wet) a dry cement composition. Testing suggested that it was precisely the configuration of the '263 trough bottom that presented the problem to be overcome yet taught no solution to the problem.

It is respectfully submitted that none of the known prior art systems and apparatus, including Hewitt '263, include, disclose, teach, suggest, show, or otherwise render obvious, either singly or when considered in combination, the invention described herein. In fact, Hewitt positively teaches away from the solution provided by the present invention.

BRIEF SUMMARY OF THE INVENTION

The present invention is a highly efficient manually operated cement mixer. The mixer improves over known art by providing an oscillating mixer having a trough configured to create eddies and currents in the load during mixing so as to facilitate thorough and rapid mixing of the composition.

The present invention provides means for mixing small volumes of cements in a manner considerably more efficient and less time consuming than by using wheelbarrows, tarps, or buckets. The inventive mixer requires no electricity, is extremely portable, and is simple in operation. It is capable of mixing a bag of cement in less than 90 seconds.

The present invention comprises a deliberate, direct, and unexpected improvement over the design of Hewitt '263, and it is the expression of the inventive insight that Hewitt essentially got it wrong about eddies and currents effective for mixing a slurry, such as cement. The present inventor appreciated that the formation of eddies and even turbulence in the load as it is agitated would greatly increase the rate at which a load could be mixed. Based on that insight, a third trough was added to the bottom of the mixing box as shown in Hewitt '263 so as to induce eddies and turbulence and to provide a space or volume in which especially effective mixing would occur. The improved design results in a significant reduction in the time and effort needed to complete the mixing of a load.

The present invention also takes advantage of an unforeseen advantage achieved by increasing the rate of acceleration of the load into the mixing compartment. Observations suggested that the mixture accelerated nicely down the straight sides of the trough but collided into, rather smoothly sliding through, the curve at the bottom of the trough. A transition better than a tangent into arc was therefore sought.

It was appreciated that in nature, a projectile moves through the air smoothly and seamlessly decelerating and then accelerating under gravity in a parabolic arc ($y=x2-x+C$). This type of smooth, seamless acceleration for the mixing composition was therefore sought for the inventive mixer. Accordingly, the shape of the side-by-side (left and right) compartments in the present invention were advantageously improved from compartments having a generally circular curve or arc and a tangent to a single, continuous, parabolic curve extending from the top edge of the trough to the center mixing compartment. The shape of the center circular mixing compartment was left largely intact. The results were dramatic for accelerating the slurry and for the resultant velocity as it entered the mixing compartment and the turbulence it produced.

Finally, a simple but significantly important advantage resides in the axle configuration, in which structurally robust axles are disposed only outwardly from side panels for placement in journals or bushings on the base frame. This keeps the entirety of the open top unobstructed so as to facilitate the insertion of tools, specifically shovels, into the mixing box. By contrast, Hewitt included an axle extending though the mixing box, and this presented a literal bar to entirely unimpeded access to the mixing box volume.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which forms the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways. It is important, therefore, that the claims are regarded as including such equivalent constructions as far as they do not depart from the spirit and scope of the present invention. The fundamental aspects of the invention, along with the various features and structures that characterize the invention, form a part of this disclosure and are pointed out with particularity in such claims. In the meantime, for a better understanding of the present invention, its advantages and the specific objects attained by its uses, reference should be made to the accompanying drawings and descriptive matter in which there are illustrated the preferred embodiment.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
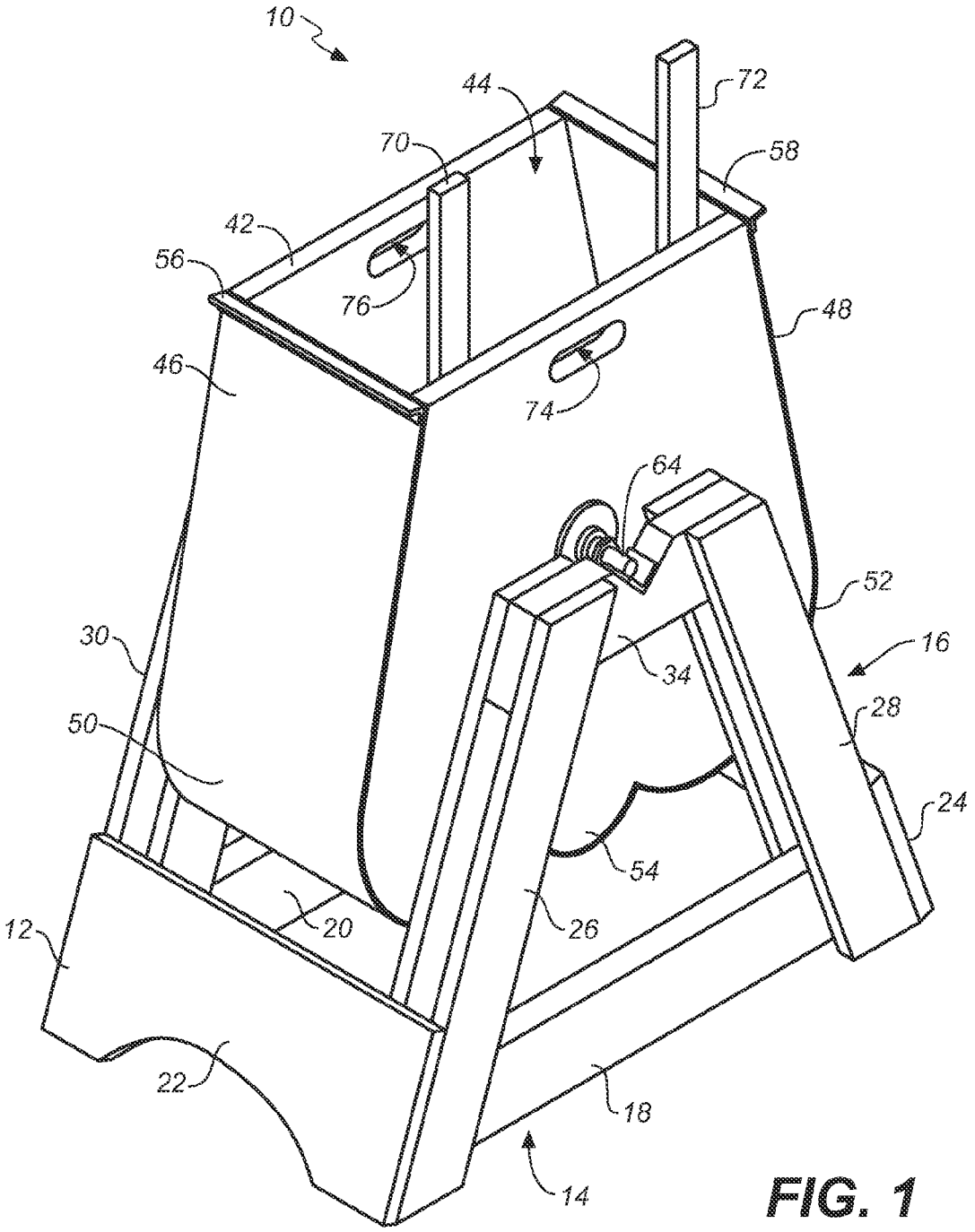
FIG. 1 is an upper left front perspective view showing the inventive cement mixer of the present invention.
Figure 2:
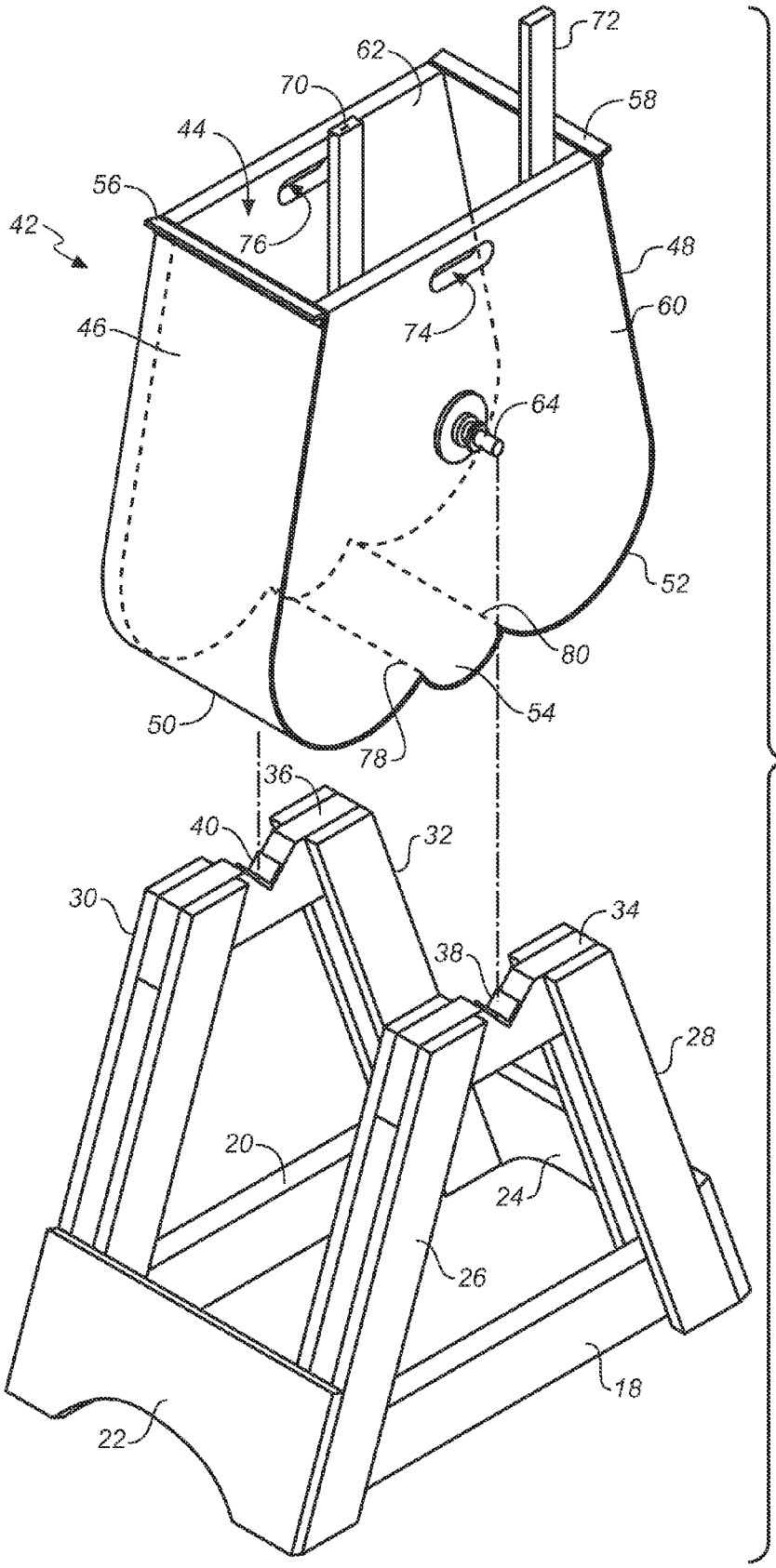
FIG. 2 is an exploded view thereof.
Figure 3:
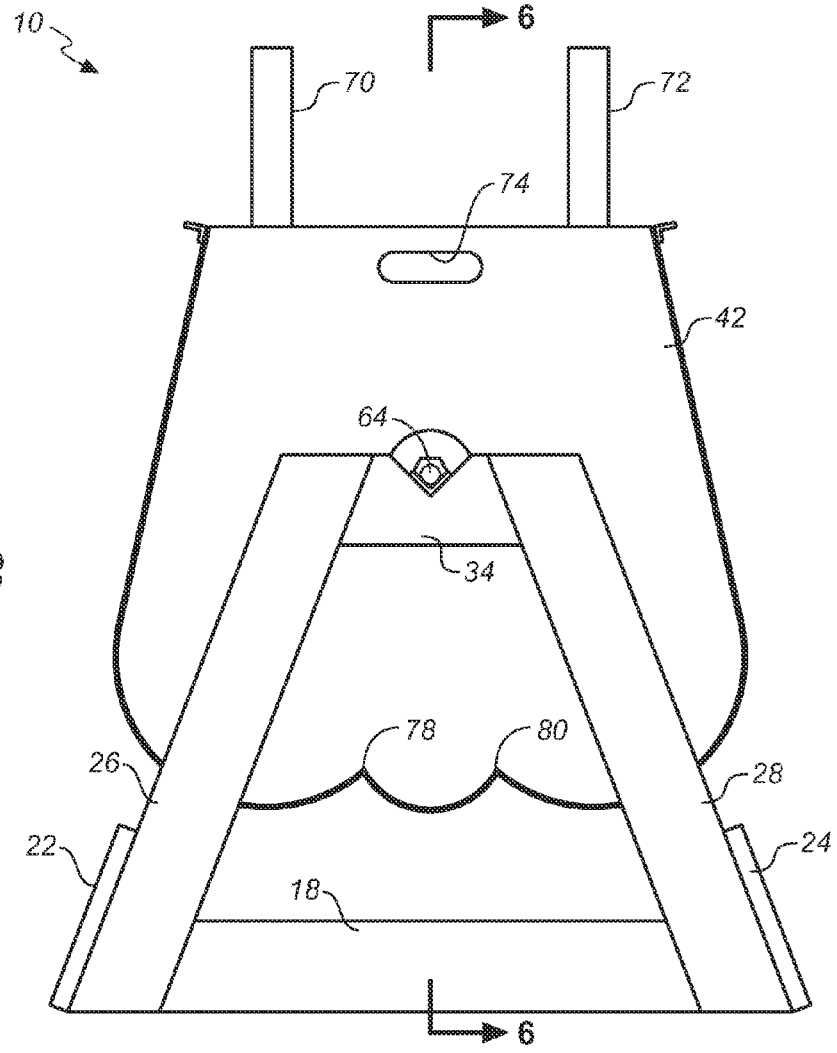
FIG. 3 is a front view in elevation thereof.
Figure 4:
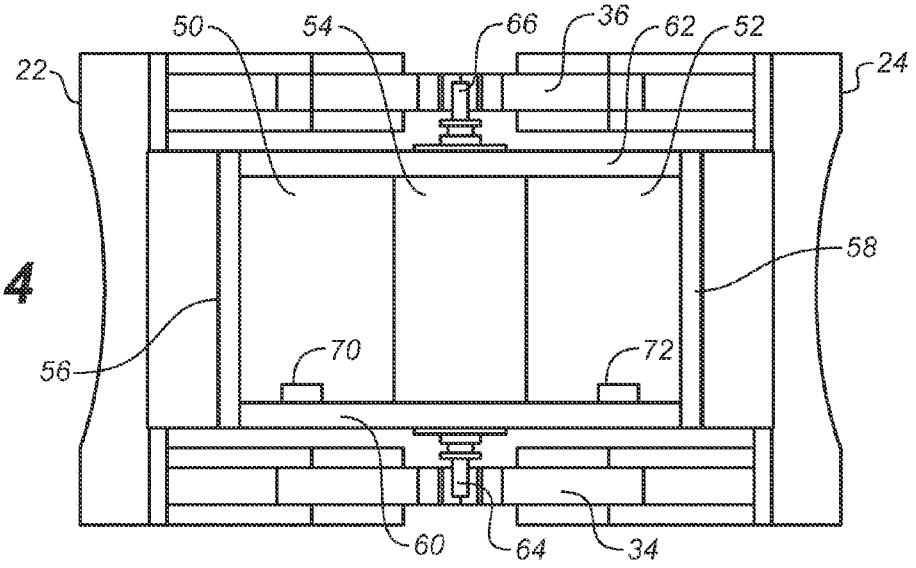
FIG. 4 is a top plan view thereof.

Referring to FIGS. 1 through 7, wherein like reference numerals refer to like components in the various views, there is illustrated therein a new and improved manually operated cement mixer, generally denominated 10 herein. The views illustrate a preferred embodiment and collectively show that the inventive apparatus includes a base frame 12 having a ground-engaging portion 14 and a generally upright support portion 16. The ground-engaging portion includes front and rear longitudinally disposed members 18, 20 and left and right cross members 22, 24, respectively. The support portion includes left and right inwardly angling supports, 26, 28, 30, 32, respectively, each pair converging but not joining at their uppermost portion. Front and rear longitudinally disposed beams 34, 36 join supports 26-32. Each beam is notched to form an open journal box 38, 40.

The base frame supports a mixing box 42 having a substantially rectangular open top 44, and left and right sides 46, 48 that slope taper outwardly in a generally parabolic curve to form left and right arcuate troughs 50, 52. The radius of curvature of the right and left troughs is small enough as they curve inwardly, and the longitudinal dimension of the mixing box is large enough, that there is sufficient space for a third trough, i.e., a medial trough 54.

Left and right flanges 56, 58, are disposed at the upper rims of the right and left sides so as to provide finger holds for manipulating the mixing box at various times during operation.

Closure of the mixing box is completed by front and rear side panels 60, 62, on each of which is mounted an axle 64, 68, front and rear, respectively, each of which rests in one of the open journal boxes, 38, 40.

Handles 70, 72 are provided on the front side panel, either on the inside surface in the mixing box or on the exterior side of the front side panel, for manually introducing oscillating motion in the mixing box. Cut out hand holds 74, 76 are also provided in each of the front and rear side panels to facilitate carrying and placing and removing the mixing box from the base frame.

Importantly, the mixing box includes not one, but two ribs 78, 80, right and left, respectively, where the upwardly tending parabolic curves are truncated by the medial trough 54. This is where much of the efficacy of the inventive apparatus resides.

Figure 5:
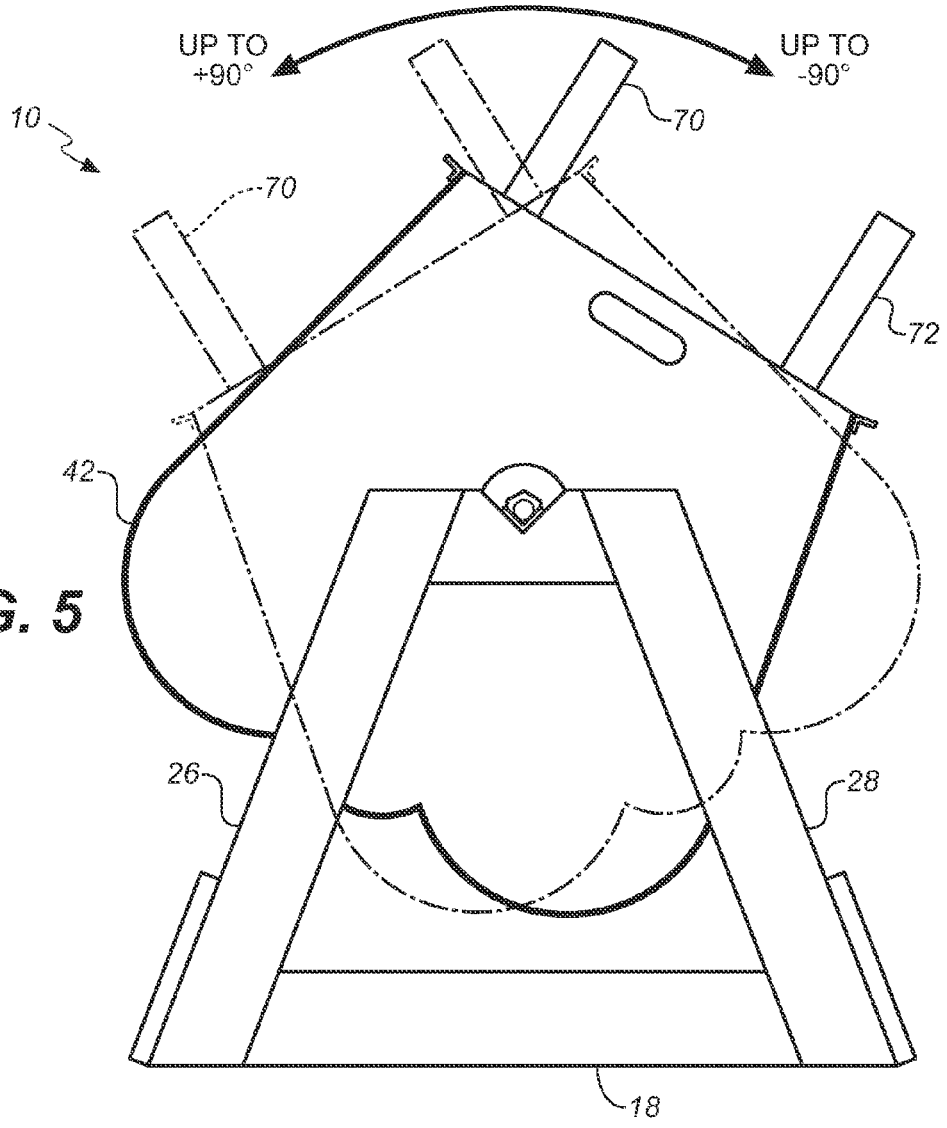
FIG. 5 is a front view in elevation showing the mixer in operation.
Figure 6:
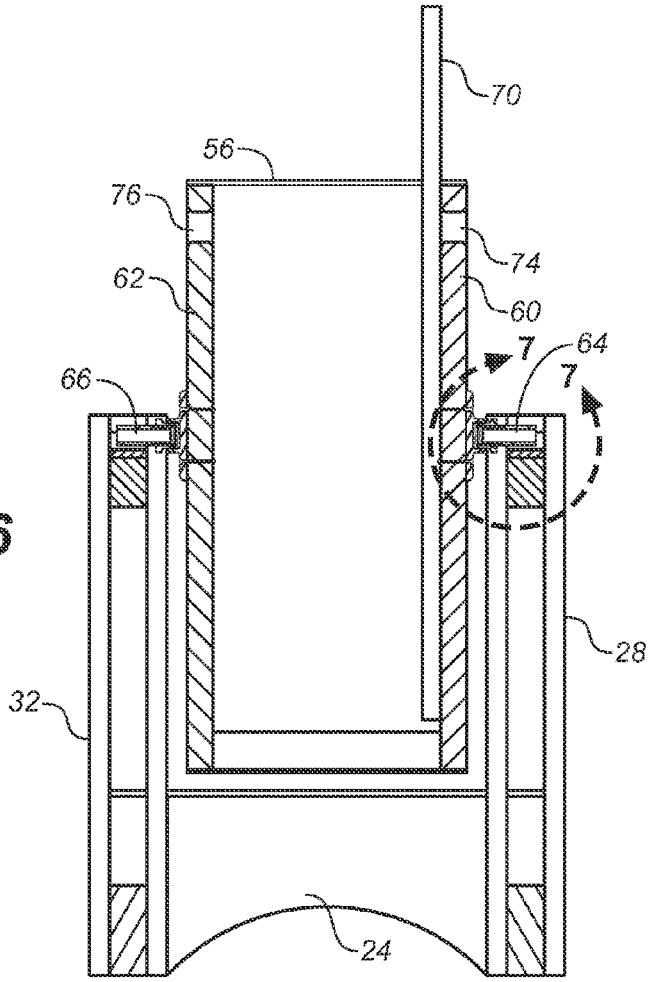
FIG. 6 is a cross-sectional side view in elevation taken along section line 6-6 of FIG. 3.
Figure 7:
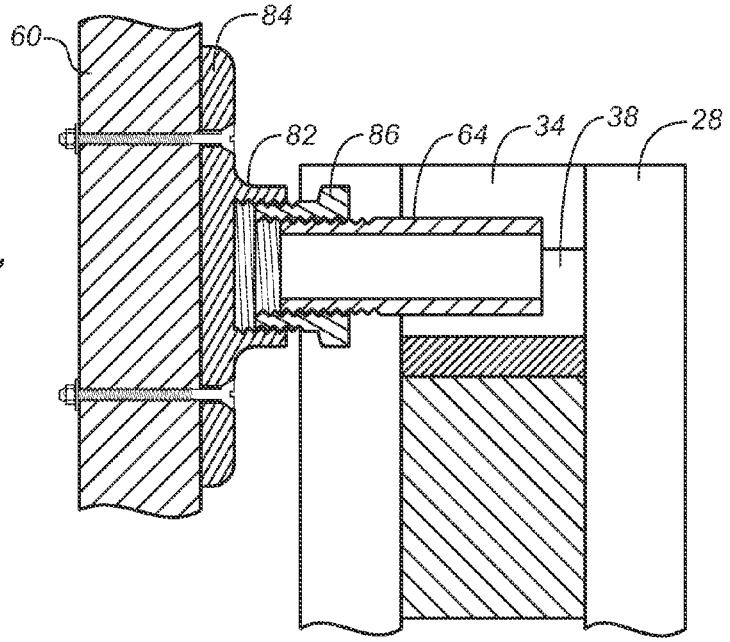
FIG. 7 is a detailed cross-sectional side view showing how the mixer axles are mounted in their respective journals.

Referring next to FIG. 5, it is seen that oscillations can be induced simply by pulling the handles 70, 72 to the right and left. The load thereby flows into and sloshes between the volumes defined by the left, right, and medial troughs as the mixing box is tipped first one way, and then the next. As indicated above, it has been found that the medial trough, and the ribs, induce eddies and currents in the slurry that actually facilitates, rather than inhibits, rapid mixing. Finally, referring now to FIGS. 6 and 7, there is seen mounting detail for the axles disposed on the front and rear side panels. It will be seen that the axles are directly or indirectly threadably inserted into a threaded mounting boss 82 integral with a mounting plate 84 screwed or bolted onto the front and rear panels. A double-threaded adjustment nut 86 may be interposed between the mounting boss and the axle if adjustability is desired.

Empirical testing and test results: To quantify the results of the improvements, a 60 lb bag of Sakrete concrete was mixed with three quarts of water in the triple compartment trough of the present invention. The number of mixing cycles, center to right and back, and center to left and back needed for a complete mix was noted at 17 (9 to the left and 8 to the right), the extent of oscillations was noted as a full 90 degrees, plus or minus (see FIG. 5), and the speed of an oscillation at 3 seconds, giving a total mixing time of 51 seconds. At the conclusion of the mixing cycle two each cylindrical test specimens were poured.

A second 60 lb bag of Sakrete concrete was mixed in the Hewitt '263 mixer. The same volume of water was used, the number extent and speed of the oscillations was repeated and again, two each cylindrical test specimens where poured. The specimens were tested in accordance using ATSM C39 test standards (i.e., the Standard Test Method for Compressive Strength of Cylindrical Concrete Specimens) under the supervision of a licensed professional Engineer. All specimens were wet cured as required until the test date. The specimens from each mixer were tested seven and eighteen (18) days after they were poured.

At day 7, the maximum load borne by a first specimen mixed in the Hewitt '263 mixer was 32,390 pounds and its compressive strength ($f'_c$) was calculated at 2,580 psi. At day 18, the load borne by the second specimen from in the Hewitt '263 mixer was 45,120 pounds, and the compressive strength was 3,590 psi. By contrast, at day 7, the first specimen mixed in the inventive mixer supported a maximum load of 34,520 pounds and had a compressive strength of 3,730; and at day 18, the specimen from the inventive mixer supported 57,880 and has a compressive strength of 4,610 psi.

From the foregoing, it will be seen that in its most essential aspect, the inventive manual cement mixer of the present invention comprises a mixing box having an open top, generally planar front side and rear side panels, and arcuate right and left sides forming left and right arcuate troughs and a medial trough disposed therebetween, each of the troughs defining a mixing volume; a base frame for supporting said mixing box; and pivoting means for removably mounting the mixing box on the base frame and for manually inducing oscillations in the mixing box.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A manual cement mixer, comprising:

a base frame;

a mixing box pivotally mounted on said base frame such that oscillations can be manually induced in said mixing box, said mixing box having an open top, generally planar front side and rear side panels, and arcuate right and left imperforated side walls forming left and right imperforated arcuate troughs and an imperforated medial trough disposed therebetween, said troughs defining a mixing volume;

wherein said right, left, and medial troughs are configured so as to induce eddies in a slurry contained therein when said mixing box is oscillated.

2. The manual cement mixer of claim 1, wherein said arcuate left and right imperforated side walls slope outwardly from said open top in a curvature to form said left and right arcuate troughs, wherein said curvature is-such that said arcuate left and right imperforated side walls curve upwardly medially in said mixing box so as to form space for said imperforated medial trough, and said imperforated medial trough is disposed therein.

3. The manual cement mixer of claim 2, wherein said curvature is a generally parabolic curvature.

4. The manual cement mixer of claim 1, wherein said base frame includes a ground-engaging portion and an upright support portion.

5. The manual cement mixer of claim 4, wherein said ground-engaging portion includes a combination of angled supports, longitudinally disposed members, and cross members.

6. The manual cement mixer of claim 5, wherein said support portion includes left and right inwardly angling supports, a first pair of said left and right inwardly angling supports converging but not joining at their uppermost portion in front of said front side panel and a second pair of said left and right inwardly angling supports converging but not joining at their uppermost portion behind said rear side panel, and further including front and rear longitudinally disposed beams joining said first pair and said second pair, respectively, of said left and right angling supports.

7. The manual cement mixer of claim 6, wherein each of said longitudinally disposed beams includes a journal box, and further including a front axle extending from said front side panel and a rear axle extending from said rear side panel, said front and rear axles pivotally disposed in one of said journal boxes.

8. The manual cement mixer of claim 1, wherein said mixing box includes left and right flanges disposed on said right and left imperforated side walls so as to provide finger holds for manipulating the mixing box at various times during operation.

9. The manual cement mixer of claim 8, further including handles affixed to said front side panel for manually introducing oscillating motion in said mixing box.

10. The manual cement mixer of claim 9, wherein oscillations can be induced in said mixer by pulling said handles and pivoting said mixing box about a transverse axis.

11. The manual cement mixer of claim 1, wherein said front side and rear side panels include cut out hand holds to facilitate carrying and placing and removing the mixing box from the base frame.

12. The manual cement mixer of claim 1, wherein said arcuate left and right imperforated side walls curve upwardly and inwardly and are truncated in left and right ribs, respectively, each of said ribs extending from said front side panel to said rear side panel.

13. The manual cement mixer of claim 12, wherein said ribs define said medial trough.

14. The manual cement mixer of claim 1, further including a front axle disposed in said front side panel and a rear axle disposed in said rear side panel, wherein each of said front and rear axles is threadably inserted into a threaded mounting boss integral with a mounting plate affixed to one of said front and rear side panels, and said front and rear axles are pivotally coupled to said base frame.

15. An oscillating manual mixer, comprising:

a base frame; and a mixing box pivotally supported on said base frame, said mixing box including a right imperforated arcuate trough, a left imperforated arcuate trough, and a medial imperforated arcuate trough disposed between said right and left imperforated arcuate troughs, said right, left and medial imperforated arcuate troughs defining a mixing volume which contains concrete slurry during mixing;

wherein said right imperforated arcuate trough, said left imperforated arcuate trough, and said medial imperforate arcuate trough are configured in combination so as to induce eddies in a slurry contained therein when said mixing box is oscillated.

16. The oscillating mixer of claim 15, wherein said left and right imperforated arcuate troughs each have a side comprising a continuous parabolic curve extending from a top edge of said mixing box to said medial imperforated arcuate trough.

17. The oscillating manual mixer of claim 16, wherein said medial imperforated arcuate trough is separated from said left and right imperforated arcuate troughs by a rib disposed at the end of each of said continuous parabolic curve of said right and left imperforated arcuate troughs, respectively.

18. The oscillating manual mixer of claim 15, further including handles for lifting and removing said mixing box from said base frame to facilitate pouring a slurry from said mixing box.

* * * * *